United States Patent [19]

Isaka

[11] Patent Number: 4,639,119

[45] Date of Patent: Jan. 27, 1987

[54] PROCESS KIT AND AN IMAGE FORMATION APPARATUS USING THE PROCESS KIT

[75] Inventor: Kazuo Isaka, Kawasaki, Japan

[73] Assignee: Canon Kabushiki Kaisha, Tokyo, Japan

[21] Appl. No.: 715,578

[22] Filed: Mar. 22, 1985

Related U.S. Application Data

[63] Continuation of Ser. No. 374,055, May 3, 1982, abandoned.

[30] Foreign Application Priority Data

May 12, 1981 [JP] Japan ..... 56-71227

[51] Int. Cl.[4] ..... G03G 15/09

[52] U.S. Cl. ..... 355/3 DD; 118/658; 355/15

[58] Field of Search ..... 355/3 R, 3 DD, 14 D, 355/15; 118/656, 657, 658, 661

[56] References Cited

U.S. PATENT DOCUMENTS

| | | | |
|---|---|---|---|
| 3,834,804 | 9/1974 | Bhagat et al. | 355/15 X |
| 3,880,518 | 4/1975 | Chatfield | 355/3 R X |
| 3,976,371 | 8/1976 | Moser et al. | 355/3 DD |
| 3,985,436 | 10/1976 | Tanaka et al. | 355/8 |
| 4,271,784 | 6/1981 | Ishimoto et al. | 355/3 DD X |
| 4,286,861 | 9/1981 | Matsumoto et al. | 355/3 |
| 4,373,468 | 2/1983 | Suda et al. | 355/3 DD X |
| 4,391,503 | 7/1983 | Pugh | 355/3 DD |

FOREIGN PATENT DOCUMENTS 47072 4/1981 Japan .

*Primary Examiner*—Fred L. Braun

*Attorney, Agent, or Firm*—Fitzpatrick, Cella, Harper & Scinto

[57] ABSTRACT

In a removable process kit for a copying apparatus having a device such as a developing device and/or cleaning device which includes a magentic field generator such as magnet roll, the process kit is designed so that the magnetic field generator can be removed from the process kit. Thus, the magnetic field generator can be used with the main body of the copying apparatus for a long period of time independently of the durability of the process kit. The heavy magnetic field generator need not be provided in the process kit itself and this leads to light weight and reduced cost of the kit.

14 Claims, 6 Drawing Figures

PROCESS KIT AND AN IMAGE FORMATION APPARATUS USING THE PROCESS KIT

This application is a continuation of application Ser. No. 374,055 filed May 3, 1982, now abandoned.

BACKGROUND OF THE INVENTION

1. Field of the Invention

This invention relates to improvements in the technique of using an image formation apparatus while dividing it into a main body and a process kit removably mountable with respect to the main body.

2. Description of the Prior Art

An electrophotographic copying apparatus is taken as an example of the image formation apparatus. In such a copying apparatus, there are sometimes disposed around a photosensitive medium magnetic rollers which are magnetic field generating means. For example, in the developing device for developing the latent image on the photosensitive medium, such magnetic roller is used to stir toner or convey toner to the latent image. On the other hand, in the cleaning device for removing any toner remaining on the photosensitive medium, such magnetic roller is used to convey the collected toner.

These magnetic rollers are constructed by magnetizing magnetic members or by embedding a plurality of long magnets or adhesively securing them together. Thus, the magnetic rollers themselves are expensive and heavy parts, but the durability thereof can be made semipermanent.

It is known to use an image formation apparatus while dividing it into a main body and a process kit removably mountable with respect to the main body. Examples of such process kit include a photosensitive medium which may become exhausted or deteriorated with formation of images, a discharger including corona wire, a developing device and a cleaning device or a combination thereof, all of these being made removably mountable with respect to the main body. Such process kit may become exhausted or deteriorated with formation of images and there would occur to mind a method of use comprising replacing it with a new kit. As another example of use, there would occur to mind a method of use comprising preparing a plurality of process kits corresponding to the differences in color of toner or preparing a kit including a developing device exclusively for half-tone and a kit including a developing device exclusively for characters and inserting into the main body a kit suited for the purpose of use.

Where a developing device and a cleaning device exist on the process kit side which is removably mountable with respect to the main body as described above, it would occur to mind to provide the magnetic field generating means such as magnet rollers integrally with the kit for the movement or conveyance of toner.

Generally, however, the magnetic field generating means are not only heavy but also suffer from no extreme consumption or deterioration. Accordingly, providing the magnetic field generating means in each process kit makes the kit heavy and in addition, it would be very uneconomical to discard the kit in accordance with the durability limit of the kit.

SUMMARY OF THE INVENTION

It is an object of the present invention to supply an image formation apparatus which eliminates the abovenoted inconveniences of the prior art and a process kit used in such apparatus. It is a further object of the present invention to provide a process kit which is inexpensive and light in weight.

According to the present invention which achieves these objects, an image formation apparatus is divided into a main body and a process kit removably mountable with respect to the main body and when the process kit inserted with respect to the main body has a process construction portion using magnetic field generating means, the magnetic field generating means is removed from the process kit in connection with the separation of the process kit from the main body and this removed magnetic field generating means again acts as magnetic field generating means with respect to another kit inserted instead of the separated kit.

The magnet rollers or electromagnets are conceivable as the magnetic field generating means of the present invention. Further, the process kit refers to members and means removably mountable with respect to the main body and used for image formation or a combination of them. These process kits are replaced with new kits by the reason of the deterioration or consumption of the constituent members, or replaced with other kits so that a kit suited for the purpose of use may be used. The magnetic powder carried by the magnetic field of the magnetic field generating means is not only magnetic toner but also, when use is made of a developer having magnetic carrier and toner as the chief components, this magnetic carrier is the magnetic powder.

The invention will become more fully apparent from the following detailed description thereof taken in conjunction with the accompanying drawings.

DESCRIPTION OF THE PREFERRED EMBODIMENTS

The details of the present invention will hereinafter be described with respect to embodiments thereof and by reference to the drawings.

Figure 1:
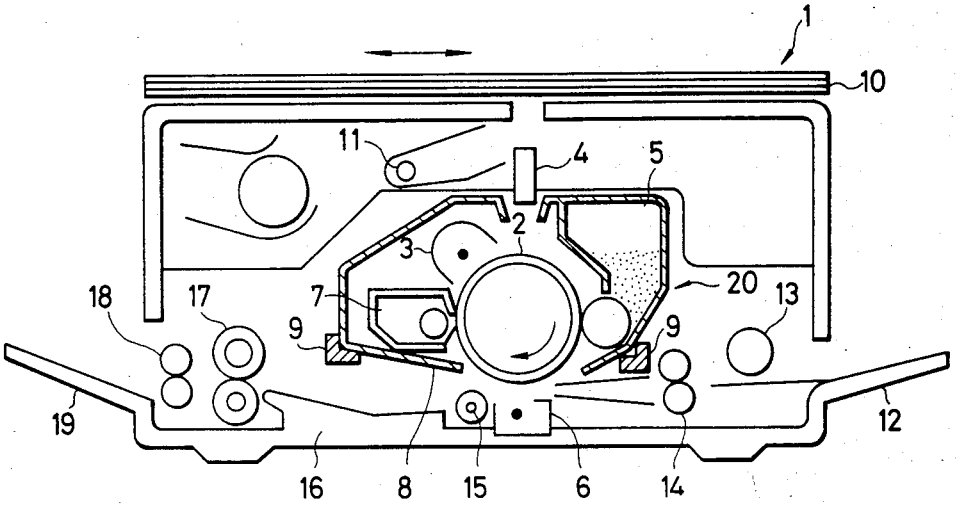
FIG. 1 is a side view of a copying apparatus to which the present invention is applicable.

Referring to FIG. 1, it is a side view of essential portions of an electrophotographic copying apparatus to which an embodiment of the present invention is applied.

Generally designated by 1 is a copying apparatus using the electrophotographic method. In the apparatus 1, a photosensitive drum 2 comprising a photoconductive layer provided on an electrically conductive drum substrate is supported for rotation in the direction of arrow. Around the drum 2 in the rotational direction thereof, there are disposed a corona discharger 3, a short focal length optical element array 4, a developing device 5, an image transfer corona discharger 6 and a cleaning device 7. In this apparatus 1, the discharger 3, the developing device 5 and the cleaning device 7, with the photosensitive drum 2, are integrally supported as a process kit 20 by a housing 8. The housing 8 is guided and supported by guide rails 9 secured to the apparatus body side and is removably mounted with respect to the apparatus body.

In the above-described apparatus, the surface of the photosensitive drum 2 is uniformly charged to a predetermined polarity, and then an original on an original carriage reciprocally movable on top of the apparatus body is illuminated by a lamp 11 and the drum 2 is exposed to the reflected light from the original through the element array 4 to thereby form a latent image on the surface of the drum 2. The latent image thus formed is developed by the developing device 5 and the developed image is transferred onto a transfer medium by the image transfer corona discharger 6. The transfer medium is supplied from a transfer medium supply tray 12 by the manual operation of the operator and conveyed to an image transfer station through a conveyor roller 13 and timing rollers 14. After the image transfer has been done, the transfer medium is separated by separating means 15 and transported through a passage 16 to a fixing device 17 for fixation, whereafter it is discharged through discharge rollers 18 onto a discharge tray 19. On the other hand, the surface of the photosensitive drum 2 after the image transfer is cleaned by the cleaning device 7 to remove any toner remaining thereon, thus becoming ready for the next cycle of copying.

Figure 2:
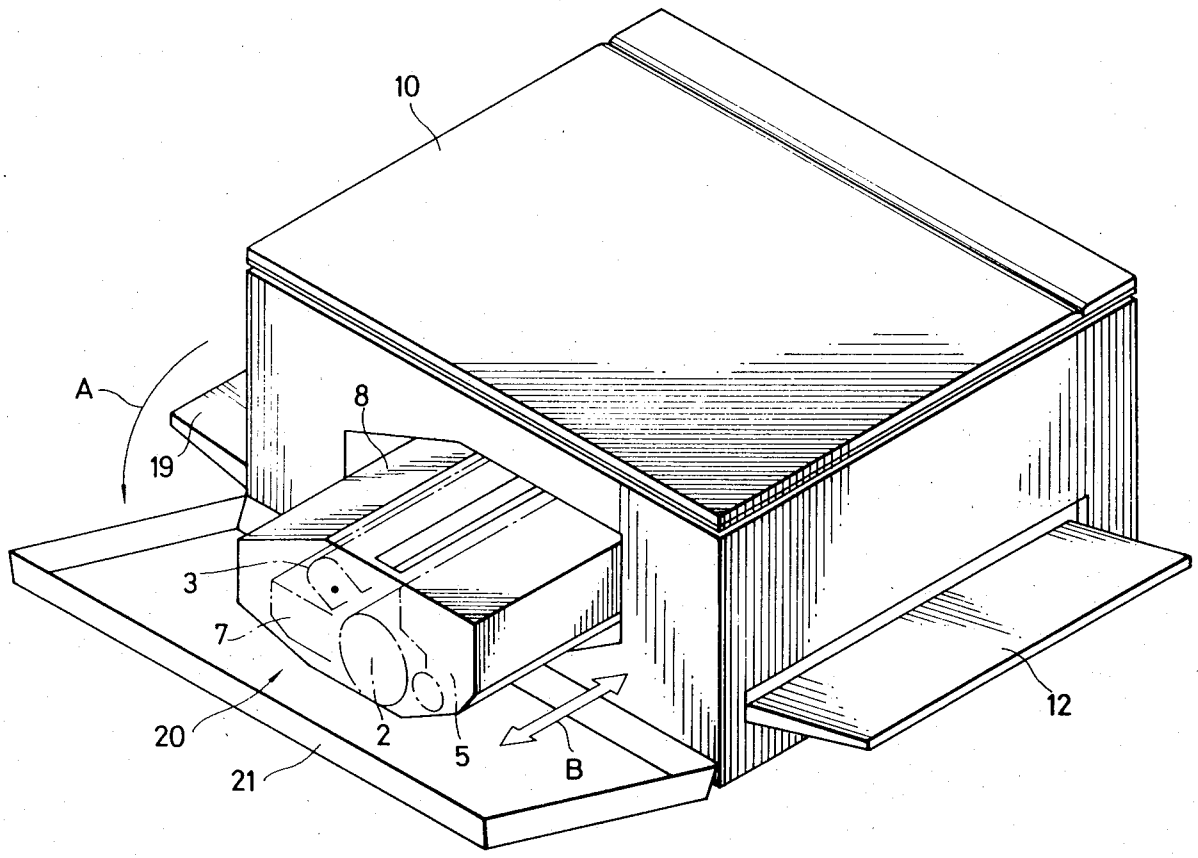
FIG. 2 is a perspective view showing the manner in which a process kit is mounted or dismounted with respect to the copying apparatus of FIG. 1.

FIG. 2 is a perspective view showing the mounting-dismounting relationship between the apparatus body and the process kit 20. The mounting of the process kit including the photosensitive drum may be accomplished by opening the front door 21 of the main body in the direction of arrow A and manually drawing out the housing 8. The arrow B in FIG. 2 indicates the direction of movement of the housing accompanying the mounting-dismounting of the process kit.

Figure 3:
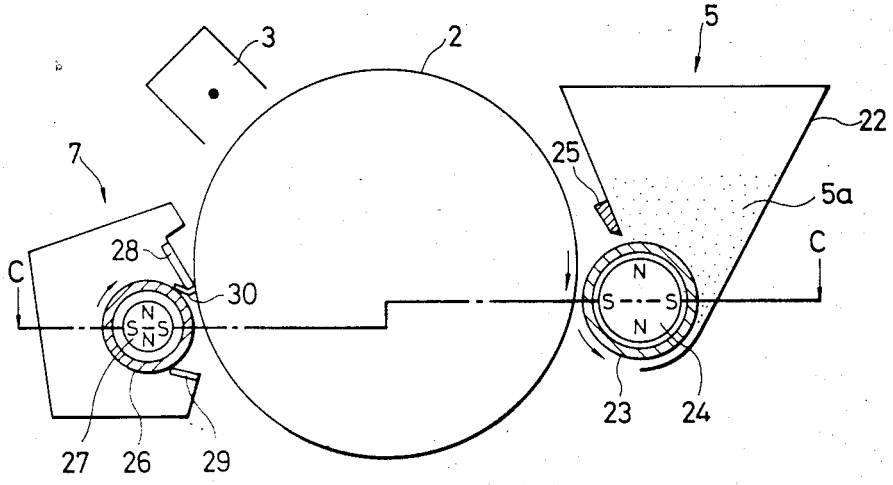
FIG. 3 is a schematic view showing the essential portions of the process kit.

FIG. 3 is a schematic, enlarged, cross-sectional view of the portions around the photosensitive drum in said process kit. The developing device 5 contains toner 5*a* in the hopperlike container 22 thereof, and in the lower portion thereof, there are a non-magnetic sleeve 23 rotatable in the direction of arrow and a magnet roller 24 secured therewithin. As a result, when the sleeve 23 is rotated in the direction of the arrow, the toner on the sleeve 23 in the container 22 is controlled to a predetermined thickness by a blade 25 secured to the exit portion of the roller. By the sleeve 23 being further rotated, the toner on the sleeve comes to the developing position.

In the above-described developing device, in some cases, the magnet roller should preferably be kept unmoved after the position adjustment of the magnetic poles has been terminated, because the position of the magnetic pole at the developing position greatly affects the development result. This also holds true of the magnetic pole opposed to the blade 25 and, to prevent the thickness of the toner on the sleeve from being varied by the position of this magnetic pole, the magnet roller must sometimes be kept fixed during the use of the main body side after the positions and angles of the magnetic poles have been adjusted.

On the other hand, in the apparatus of the present embodiment, the cleaning device 7 is provided with a fixed sleeve 26 and a magnet roller 27 disposed therein and rotatable in the direction of the arrow. A cleaning blade 28 for scraping off any toner remaining on the photosensitive drum 2 is disposed above the sleeve 26, and the toner scraped off falls onto the sleeve 26 and is conveyed into the cleaning device 7 by rotation of the magnet roller 27 and scraped off by a scraper 29. Accordingly, the cleaning blade 28 must be urged against the photosensitive drum 2 with an appropriate pressure.

Even after the cleaning device 7 has been removed from the main body 1, the exit is closed by the cleaning blade 28, the sleeve 26 proximate thereto and a thin film sheet 30 mounted on the end of the cleaning blade 26 and lightly in contact with the sleeve 26 and therefore, the toner does not leak out of the cleaning device even if the magnet roller 27 is not present.

Figure 4:
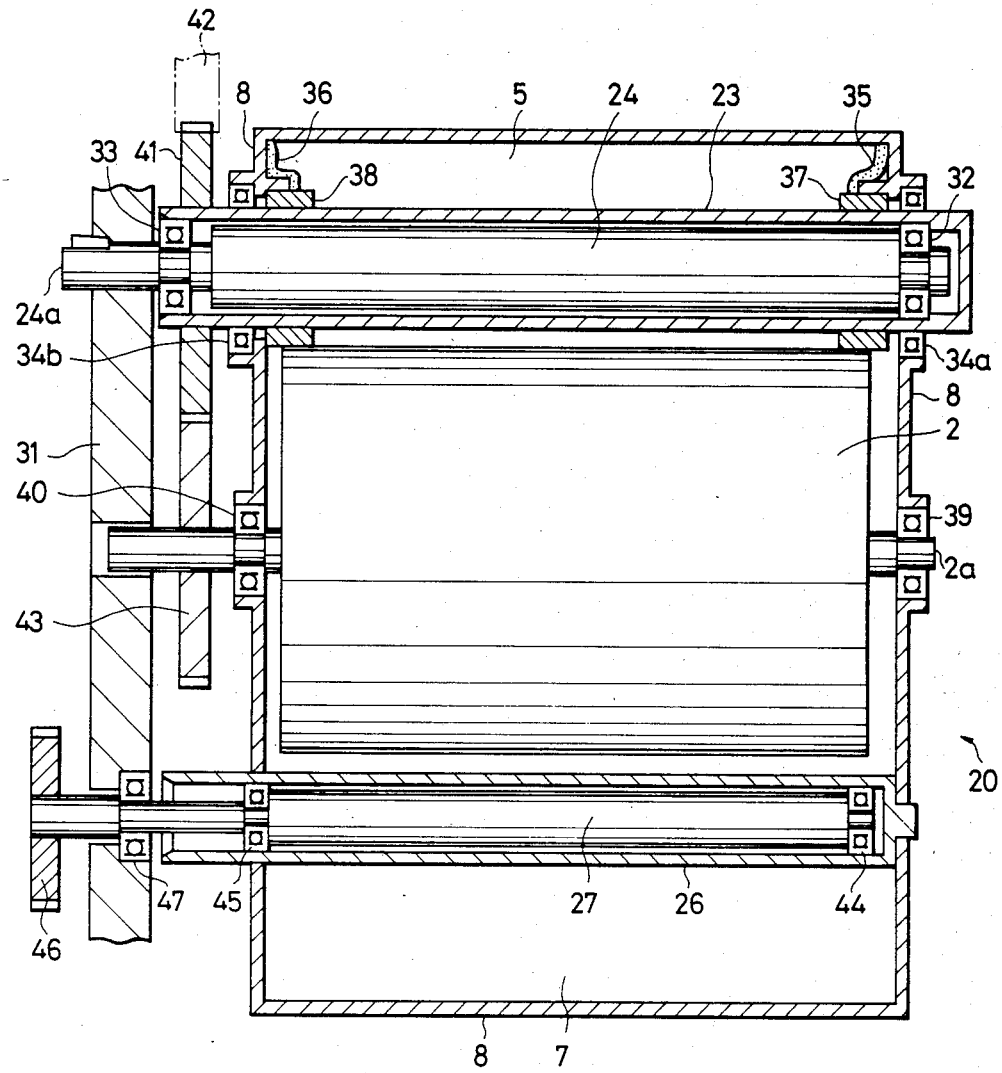
FIG. 4 is a cross-sectional view of the process kit taken along line C—C of FIG. 3 and corresponding to the schematic view of FIG. 3.
Figure 5:
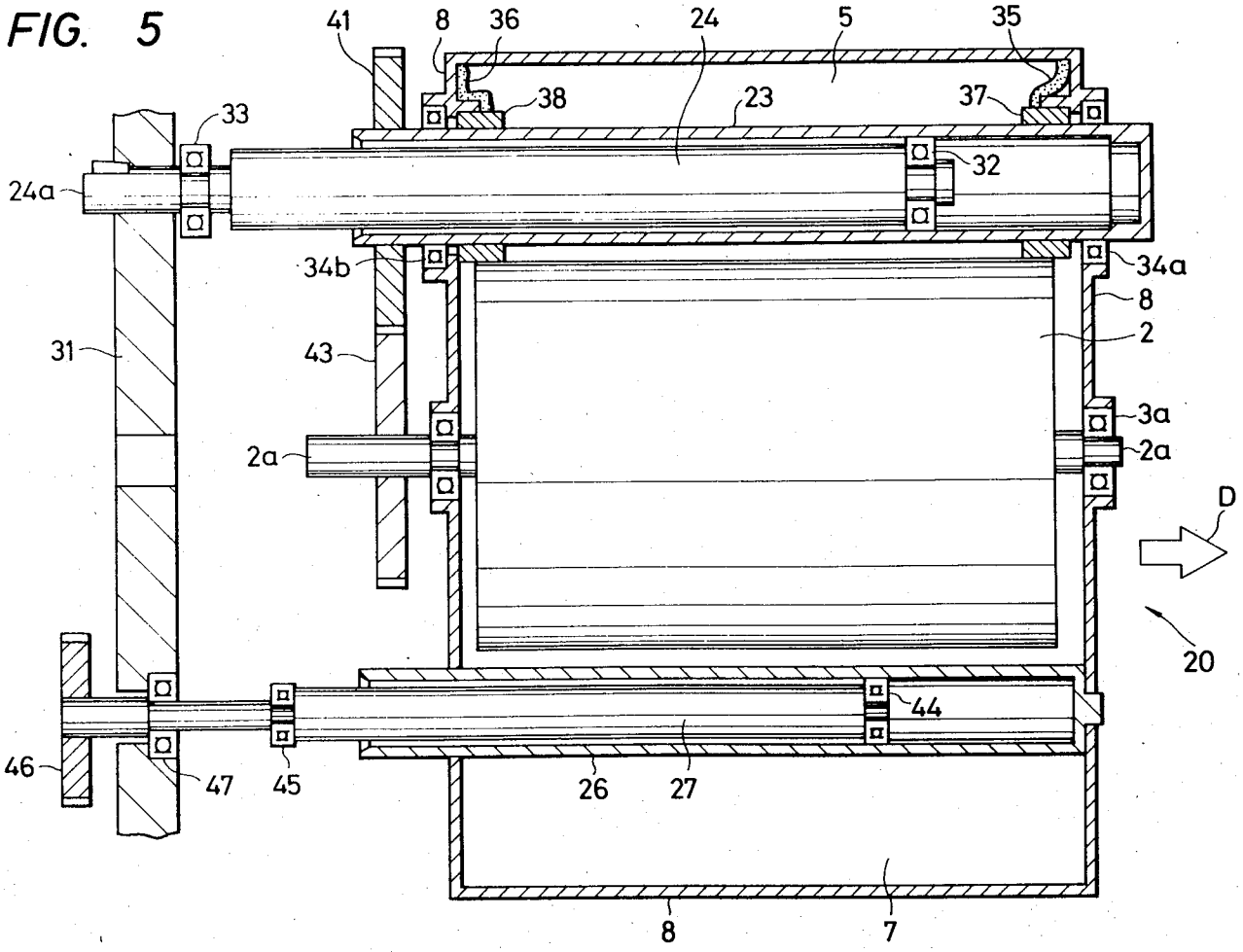
FIG. 5 is a cross-sectional view showing the condition in which the process kit has been drawn out from the apparatus body.

FIG. 4 is a cross-sectional view of the kit of FIG. 3 taken along line C—C of FIG. 3. FIG. 5 is a cross-sectional view of the kit when drawn out of the copying apparatus body, taken along line C—C of FIG. 3.

In FIG. 4, the magnet roller 24 of the developing device 5 has one end 24*a* thereof fixed to a side plate of the main body. Bearing members 32 and 33 are axially immovably disposed at the opposite ends of the magnet roller 24. The sleeve 23 is provided around the bearing members 32 and 33 for rotation relative to the bearing members. On the other hand, the sleeve 23 is also rotatable relative to the housing 8 of the process kit by bearing members 34*a* and 34*b*. Accordingly, the sleeve 23 can be rotated independently of the housing 8 of the kit and the magnet roller 24 therein.

The toner in the housing 8 of the developing device 5 is supplied onto the sleeve 23 with a uniform thickness by the action of the sleeve 23 and magnet roller 24 rotated by a drive mechanism which will hereinafter be described, and comes to the developing station for the photosensitive drum 2. On the other hand, the toner in the developing device 5 is intercepted by the housing 8 and by felts 35, 36 at the opposite ends of the housing and thus, does not leak outwardly of the developing device. The position of the above-described sleeve relative to the photosensitive drum 2 is attained by causing spacers 37 and 38 secured to the surface of this sleeve to bear against the peripheral surface of the photosensitive drum 2. These spacers may be formed integrally with the housing 8 of the kit. On the other hand, the photosensitive drum 2 has the rotary shaft 2*a* thereof rotatably supported by the housing 8 of the kit through bearing members 39 and 40.

In the above-described construction, the sleeve 23 is rotated by causing a first gear 41 mounted on one end of this sleeve to mesh with and rotatively drive a drive gear 42 on the main body side. The photosensitive drum 2 is rotatively driven with the rotation of the sleeve by a second gear 43 securely mounted on the rotary shaft 2*a* of the drum 2 and meshing with the first gear 41.

The cleaning device 7 will now be described. The sleeve 26 of the cleaning device is stationary relative to the rotating magnet roller 27. Therefore, the sleeve 26 is either fixed to the housing 8 of the kit or formed integrally with this housing. The magnet roller 27 is rotated within this sleeve through bearing members 44 and 45 at the opposite ends which bear against the inner peripheral surface of the sleeve. The magnet roller 27 mounted to the side plate 31 of the main body by means of a bearing member 47 is rotated by a gear 46 secured to one end of the roller being rotatably driven.

FIG. 5 is a plan view showing the condition in which the above-described process kit is being taken out or inserted in the manner as shown in FIG. 2.

To simplify the description, only the draw-out will hereinafter be described. When the process kit 20 is moved from the position of FIG. 4 in the direction of arrow D, the kit 20 can be taken out with the magnet rollers 24 and 27 fixed to the main body side being left on the side plate 31 of the main body. In this case, the bearing member 32 in contact with the inner peripheral surface of the developing sleeve 23 and the bearing member 44 in contact with the inner peripheral surface of the sleeve 26 of the cleaning device act as the guide for movement of the kit to thereby make it possible to take out the kit stably in the direction of the rotary shaft of the photosensitive drum. Accordingly, by the cooperation of the process kit of FIG. 1 with the guide 9, the process kit can be taken out without affecting the other members around it. Of course, when the combination of said sleeve and the bearing members exists in the developing device and in the cleaning device as in the present invention, the guide rails 9 need not be provided. Also, when there is only one combination of said sleeve and the bearing members in the process kit, the use of said one guide rail 9 makes smooth movement of the process kit possible.

The above-described embodiment has been shown with respect to a case where, in the developing device, the sleeve is rotatable and the magnet roller is stationary while, in the cleaning device, the sleeve is stationary and the magnet roller is rotatable. However, this relation between rotation and stationary elements may be arbitrarily set in such a fashion that, on the developing device side, the sleeve is stationary and the magnet roller is rotatable while, on the cleaning device side, the sleeve is rotatable and the magnet roller is stationary. As another example, the above-described mechanism may be incorporated only into one of the developing device and the cleaning device of the process kit.

According to the above-described embodiment, the magnet rollers separated from the process kit are secured at predetermined positions in the apparatus body and therefore, they can be caused to act as a guide during mounting-dismounting of the kit. Also, the magnet roller unrotatably fixed relative to the main body has the positions of its magnetic poles always fixed relative to the inserted kit and therefore, the necessity of re-adjusting the positions of the magnetic poles of this magnet roller each time the kit is inserted is eliminated.

Figure 6:
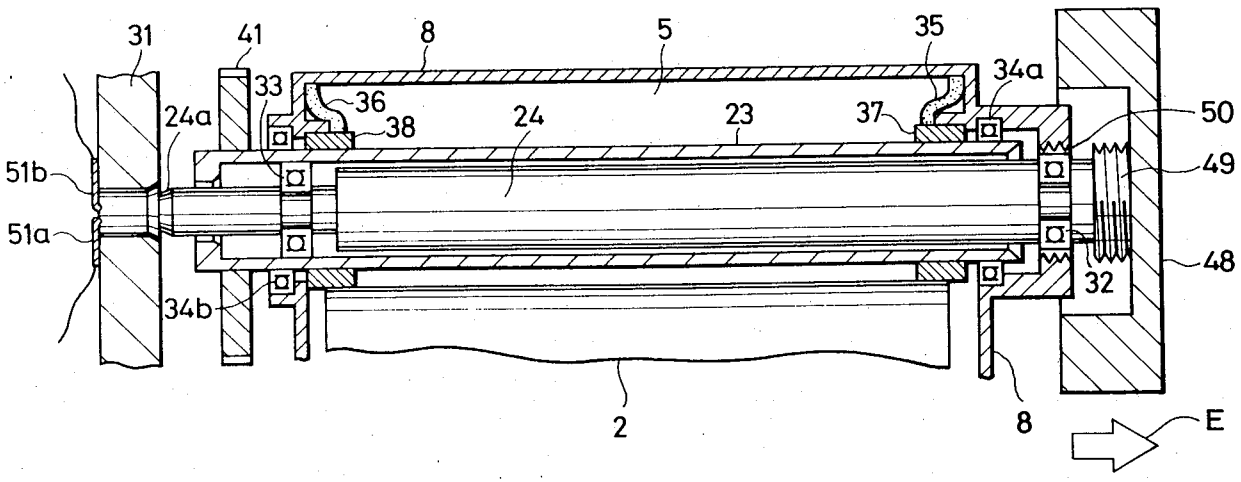
FIG. 6 is a cross-sectional view of a portion of the process kit showing another embodiment of the present invention.

FIG. 6 is a cross-sectional view of an improved example of the developing device 5 of FIG. 4. In this example, the magnet roller can be removed from the process kit after the process kit has been taken out from the main body, and the magnet roller thus removed can be utilized repetitively. In FIG. 6, parts common to those of FIG. 4 are given common reference numerals.

FIG. 6 shows a condition in which the process kit has been partly taken out from the main body and the magnet roller 24 has been slightly drawn out from the kit. As shown, the inner part of the magnet roller 24 is not fixed to the main body, so that the roller 24 is axially movable.

In this embodiment, one end of the magnet roller 24 provides a handle 48 and the inside of this handle provides an externally threaded portion 49. The externally threaded portion 49 formed integrally with the magnet roller 24 is fixedly screwed onto the internally threaded portion 50 of the kit 20. That is, when the kit 20 is fixed and the handle 48 is moved in the direction of arrow E by grasping it, only the magnet roller 24 of the developing device 5 can be drawn out. This magnet roller 24 may be drawn out either after or before the kit 20 is taken out from the main body. During the draw-out or the insertion of the magnet roller, the bearing member 33 moves on the inner peripheral surface of the sleeve 23 and is thereby guided in the sleeve, whereby the magnet roller 24 can be drawn out.

In the present embodiment, electrodes **51*a* and 51*b* are secured to the side plate 31 of the main body and, by the inner end portion 24*a* of the magnet roller 24 rendering these electrodes conductive, it is possible to confirm that the magnet roller 24 is disposed at a predetermined position in the process kit. For example, when the magnet roller 24 is not inserted but only the kit is inserted, the electrodes 51*a* and 51*b* may be rendered non-conductive, whereby it is possible that the apparatus body is not driven when the magnet roller 24** is not mounted.

According to the embodiment of FIG. 6, the magnet roller 24 is repetitively usable and this leads to the light weight and low cost of the kit itself. The construction of the present embodiment is applicable not only to the developing device but also to the cleaning device.

According to the present invention, as has been described above, the magnetic field generating means such as magnet rollers which are expensive and heavy are repetitively usable and this leads to the light weight and low cost of the process kit which is removably mountable with respect to the apparatus body. As examples of the image formation apparatus, not only copying apparatus but also facsimile, recording apparatus, etc. are conceivable and the present invention is applicable to those apparatus having the magnetic field generating means as described above.

What I claim is:

1. A process kit removably mountable with respect to the body of an image formation apparatus, said process kit having:

a housing, a magnetic powder carrying member for carrying magnetic powder developer on the peripheral surface thereof by a magnetic field generated by magnetic field generating means disposed on the opposite side from the magnetic powder carrying surface of said magnetic powder carrying member when the process kit is inserted in the apparatus body, a latent image carrying member on which an image can be developed using the magnetic powder developer, a support member for said magnetic powder carrying member which rotatably supports said carrying member on the housing of said process kit, and means defining an opening in said magnetic powder carrying member dimensioned to accept the insertion therein of the magnetic field generating means, which is mounted on the apparatus body, when said process kit is inserted in the apparatus body.

2. A process kit according to claim 1, further having means for supporting the magnetic field generating means when said process kit is inserted in the apparatus body.

3. An image formation apparatus having:

magnetic field generating means mounted on the body of said apparatus; and a process kit removably mountable with respect to said apparatus body, said process kit including a magnetic powder carrying member for carrying magnetic powder developer on the peripheral surface thereof by a magnetic field generated by said magnetic field generating means disposed on the opposite side from the magnetic powder carrying surface of said magnetic powder carrying member when the process kit is inserted in said apparatus body, a latent image carrying member on which an image can be developed using the magnetic powder developer and means for supporting said magnetic field generating means when the process kit is inserted in said apparatus body;

wherein said magnetic field generating means is left on said apparatus body when said process kit is taken out of said apparatus.

4. A process kit removably mountable with respect to the body of an image formation apparatus, said process kit having:

a housing including means defining an aperture, a hollow magnetic powder carrying member for carrying magnetic powder developer on the peripheral surface thereof by a magnetic field generated by magnetic field generating means removably held by the process kit within said magnetic powder carrying member, a latent image carrying member on which an image can be developed using the magnetic powder developer, a support member for said magnetic powder carrying member which supports said carrying member on the housing of said process kit, means for supporting the magnetic field generating means and said magnetic powder carrying member for relative rotation, and means defining an opening in said magnetic powder carrying member dimensioned to accept the insertion therein of the magnetic field generating means through the aperture in said housing, wherein the magnetic field generating means is removable from said magnetic powder carrying member which is retained in said process kit which remains intact.

5. A process kit according to claim 4, wherein said process kit is removable from the apparatus body while retaining the magnetic field generating means and said magnetic power carrying member.

6. A process kit according to claim 4, wherein the magnetic field generating means is removable from said magnetic powder carrying member when said process kit is mounted in the apparatus body.

7. An image formation apparatus having:

magnetic field generating means; and a process kit removably mountable with respect to the body of said apparatus, said process kit including a housing with means defining an aperture, a hollow magnetic powder carrying member for carrying magnetic powder developer on the peripheral surface thereof by a magnetic field generated by said magnetic field generating means removably held by said process kit within said magnetic powder carrying member, a latent image carrying member on which an image can be developed using the magnetic powder developer, means for supporting said magnetic field generating means and said magnetic powder carrying member for relative rotation, and means defining an opening in said magnetic powder carrying member dimensioned to accept the insertion therein of said magnetic field generating means through the aperture in said housing;

wherein said magnetic field generating means is removable from said magnetic powder carrying member which is retained in said process kit which remains intact.

8. An image formation apparatus according to claim 7, wherein said apparatus has a process kit which is removable from said apparatus body while retaining said magnetic field generating means and said magnetic powder carrying member.

9. An image formation apparatus according to claim 7, wherein said magnetic field generating means is removable from said magnetic powder carrying member when said process kit is mounted in said apparatus body.

10. The image formation apparatus according to claim 9, further having detector means on said apparatus body for detecting the insertion of said magnetic field generating means with respect to said process kit.

11. An image formation apparatus having:

magnetic field generating means mounted at one end thereof on the body of said apparatus;

a process kit removably mountable with respect to said apparatus body, said process kit including a magnetic powder carrying member for carrying magnetic powder developer on the peripheral surface thereof by a magnetic field generated by said magnetic field generating means disposed on the opposite side from the magnetic powder carrying surface of said magnetic powder carrying member when the process kit is inserted in said apparatus body, a latent image carrying member on which an image can be developed using the magnetic powder developer and supporting means for supporting the other end of said magnetic field generating means within said magnetic powder carrying member when the process kit is inserted in said apparatus body;

wherein said magnetic field generating means is left on said apparatus body when said process kit is taken out of said apparatus.

12. The image formation apparatus according to claim 11, wherein said supporting means serves as a guide for said magnetic powder carrying member as said process kit is taken out of said apparatus.

13. A process kit removably mountable with respect to the body of an image formation apparatus, said process kit having:

a housing including means defining an aperture, a hollow magnetic powder carrying member for carrying magnetic powder developer on the peripheral surface thereof by a magnetic field generated by magnetic field generating means removably held by the process kit within said magnetic powder carrying member, a latent image carrying member on which an image can be developed using the magnetic powder developer, a support member for said magnetic powder carrying member which supports said carrying member on the housing of said process kit, means defining an opening in said magnetic powder carrying member dimensioned to accept the insertion therein of said magnetic field generating means through the aperture in said housing, and supporting means for supporting the magnetic field generating means and said magnetic powder carrying member for relative rotation, wherein said supporting means includes releasable attaching means for removably attaching an end of the magnetic field generating means to said magnetic powder carrying member and, when said attaching means is released, enabling the magnetic field generating means to be longitudinally removed from said magnetic powder carrying member which is retained in said process kit which remains intact.

14. An image formation apparatus having:

magnetic field generating means; and a process kit removably mountable with respect to the body of said apparatus, said process kit including a housing with means defining an aperture, a hollow magnetic powder carrying member for carrying magnetic powder developer on the peripheral surface thereof by a magnetic field generated by said magnetic field generating means removably held by said process kit within said magnetic powder carrying member, a latent image carrying member on which an image can be developed using the magnetic powder developer, means defining an opening in said magnetic powder carrying means dimensioned to accept the insertion therein of said magnetic field generating means through the aperture in said housing and supporting means for supporting said magnetic field generating means and said magnetic powder carrying member for relative rotation;

wherein said supporting means includes releasable attaching means for removably attaching an end of said magnetic field generating means to said magnetic powder carrying member and, when said attaching means is released, said magnetic field generating means is longitudinally removable from said magnetic powder carrying member which is retained in said process kit which remains intact.

* * * * *